United States Patent [19]

Kaneko et al.

[11] Patent Number: 4,530,280

[45] Date of Patent: Jul. 23, 1985

[54] PRINTING HAMMER ASSEMBLY WITH A HAMMER DAMPENER COMPRISING TWO OPPOSED PERMANENT MAGNETS

[75] Inventors: Nobuo Kaneko, Kawasaki; Takeshi Takemoto, Yamato; Hiroshi Yasuda, Atsugi, all of Japan

[73] Assignees: Ricoh Company, Ltd.; Ricoh Watch Co., Ltd., Aichi, both of Japan

[21] Appl. No.: 570,492

[22] Filed: Jan. 13, 1984

[30] Foreign Application Priority Data

Jan. 17, 1983 [JP] Japan ..... 58-5596

[51] Int. Cl.[3] ..... B41J 9/42; B41J 9/00

[52] U.S. Cl. ..... 101/93.02; 101/93.48; 400/157.1; 400/157.2; 400/167

[58] Field of Search ..... 101/93.08, 93.09, 93.15, 101/93.16, 93.17, 93.18, 93.19, 93.2, 93.21, 93.02, 93.48; 400/157.1, 157.2, 157.4, 167, 174; 335/46, 175, 257, 271, 277

[56] References Cited

U.S. PATENT DOCUMENTS

| | | | |
|---|---|---|---|
| 3,117,256 | 1/1964 | Gamblin | 101/93.34 |
| 4,062,285 | 12/1977 | Deetz | 101/93.48 |
| 4,389,131 | 6/1983 | Kondo | 101/93.29 |

FOREIGN PATENT DOCUMENTS

| | | | |
|---|---|---|---|
| 2045517 | 3/1970 | Fed. Rep. of Germany | 101/93.29 |
| 2853301 | 7/1980 | Fed. Rep. of Germany | 335/257 |

OTHER PUBLICATIONS

J. E. McGuire, Print Hammer, IBM Technical Disclosure Bulletin, vol. 19, No. 6, Nov. 1976, p. 2036.

J. E. Lee and S. A. Okcuoglu, Dual-Coil Print Hammer, IBM Tech. Disclosure Bulletin, vol. 22, No. 12, May 1980, p. 5398.

A. B. Habich, Print Hammer Rebound Control, IBM Technical Disclosure Bulletin, vol. 22, No. 10, Mar. 1980, p. 4348.

*Primary Examiner*—Clyde I. Coughenour
*Assistant Examiner*—William L. Klima
*Attorney, Agent, or Firm*—Cooper, Dunham, Clark, Griffin & Moran

[57] ABSTRACT

A printing hammer assembly for use in impact printers includes a printing hammer which has an impact surface and an armature and which is supported to be movable in a reciprocating manner along its longitudinal axis, a driving solenoid which drives to move the printing hammer forward when energized against the force of a coil spring which normally applies a biasing force to the printing hammer in the backward direction and a yoke leading a magnetic flux produced by said solenoid to the armature of printing hammer. A pair of magnets are disposed such that they are magnetically repulsive to each other with one of them fixed in position and the other movable over a predetermined distance thereby allowing to absorb the rebounding energy of the hammer when it returns to its home position.

12 Claims, 3 Drawing Figures

PRINTING HAMMER ASSEMBLY WITH A HAMMER DAMPENER COMPRISING TWO OPPOSED PERMANENT MAGNETS

BACKGROUND OF THE INVENTION

1. Field of the Invention

This invention generally relates to impact printers, and, in particular, to printing hammer assemblies for use in impact printers.

2. Description of the Prior Art

Impact printers are well known in the art. There are two major categories in impact printers: one category includes line printers which print all of the characters in one printing line at the same time so that printing is carried out line by line and the other category includes serial printers which print characters serially one after another along a printing line. In the latter category, one typical example is a wheel printer which uses a print wheel, sometimes called "daisy wheel", comprised of a hub, a plurality of spokes extending radially from the hub and various types respectively provided at the free ends of the spokes, and an impact hammer for applying an impact force to a selected one of the types upon locating the selected type by rotating the print wheel at a predetermined printing position.

Printing hammer assemblies are employed in various impact hammers, whether serial or line. Such an assembly generally includes a printing hammer having an impact surface for applying an impact force to a selected type and a driving solenoid which moves the printing hammer forward electromagnetically when energized. In such printing hammer assemblies, their printing hammers are moved back and forth at high frequencies between the home or retracted position and the advanced position where the printing hammer makes contact with a selected type thereby applying an impact force to the selected type to form an imprint on recording paper. Since the impact conditions vary depending upon from where the printing hammer starts its forward movement when driven by the driving coil, it is important that the printing hammer resides at a predetermined home or retracted position at all times before being driven to move for the next printing operation. If there is a relatively large clearance for the home position of the printing hammer, the stroke of movement of the printing hammer will vary, thereby causing the quality of printed characters to deteriorate. Thus, it is important to insure that the printing hammer can be returned precisely to the same home position at all times.

One example of a prior art printing hammer assembly applied to a wheel printer using a printing wheel is illustrated in FIG. 1. As shown, the printing hammer assembly includes a printing hammer 10 having a hammer shaft 2 at its forward end and an armature 3 at its backward end, and the printing hammer 10 is supported by a pair of front and rear bearings 12 and 14 so as to be slidably movable in a reciprocating manner linearly. The assembly also includes a front yoke 22 which has a front cylindrical section 6*a* to which the front bearing 12 is fixedly mounted. A driving solenoid 24 is provided as wound around a spool 26 which, in turn, is fixedly mounted as housed in the front yoke 22. The solenoid 24 is so disposed that it can interact with the armature 3 electromagnetically when energized.

A rear yoke 28 is tightly fitted into the rear end of the front yoke 22 and the rear bearing 14 is fixedly attached to the rear yoke 28, and, thus, the front and rear yokes 22 and 28 are so combined to establish a magnetic circuit. Also provided in the assembly is a cover 30 which encloses the front and rear yokes 22 and 28. A rubber damper 20 is disposed as supported by the cover 30 at the location opposite to the rear end of the printing hammer 10, and a metal plate 18, which is a thin rigid member such as a washer, is fixedly attached to the front end surface of the rubber damper 20 thereby defining a retracted end position by the front end surface of the metal plate 18. As shown in FIG. 1, since a coil spring 16 is provided as extended between the armature 3 of the printing hammer 10 and the front bearing 12, the printing hammer 10 is located at its home or retracted position with its rear end surface abutting against the metal plate 18 when the driving coil 24 is in deenergized state. Also provided in the assembly of FIG. 1 is a protector 32 as fixedly attached at the mouth of the front cylindrical section 6*a*.

In operation, when the driving solenoid 24 is energized, there is produced a magnetic flux passing through the front yoke 22, printing hammer 10 and rear yoke 28 so that the printing hammer 10 is driven electromagnetically to move forward against the force of the compression spring 16 as indicated by the arrow A. Thus, the front end, defined as impact surface, of the printing hammer 10 applies an impact force to a selected type 36 of a print wheel 34 located at a predetermined printing position, and, therefore, the type 36 is strongly pressed against recording paper 42 placed around a platen roller 40 with an ink ribbon 38 sandwiched therebetween. Thus, an imprint of the type 36 comes to be formed on the paper 42. Upon deenergization of the solenoid 24, the printing hammer 10 returns to its home position as receiving the recovery force from the spring 16 until its rear end surface hits the washer 18.

The rubber damper 20 is provided for the purpose of absorbing the shock energy of the printing hammer 10 when it returns to its home position with the aid of the recovery force of the spring 16 in order to prevent the printing hammer 10 from rebounding, and it is typically comprised of a low elastic rubber material. A main objective of provision of the washer 18 is to prevent the rear end surface of the printing hammer 10 from being adhered to the front end surface of the rubber damper 20 because the rear end surface of the printing hammer 10 is normally kept pressed against the rubber damper 20 under the force of the spring 16.

However, in the prior art printing hammer assembly as described above, accuracy in positioning the printing hammer 10 at its home position is relatively poor due to several causes. For example, it is rather difficult to precisely control the dimensional accuracy of the rubber damper 20 such as molding accuracy and positioning accuracy. Further, the rubber damper 20 tends to deform due to aging and other environmental conditions thereby causing the retracted position to shift. Moreover, since rubber is severely affected by deterioration in durability due to aging, performance tends to fluctuate and thus operation is not trustworthy. Such irregularities in retracted position of the printing hammer will produce irregularities in the level and timing of an impact force to be applied to a selected type, and, therefore, resulting imprints will be poor in quality. Such a tendency will be made more noticeable if printing speed is desired to be increased.

SUMMARY OF THE INVENTION

The disadvantages of the prior art as described above are overcome and an improved printing hammer assembly is hereby provided.

Therefore, it is a primary object of the present invention to provide an improved printing hammer assembly.

Another object of the present invention is to provide a printing hammer assembly which may be used advantageously in impact printers.

A further object of the present invention is to provide a printing hammer assembly capable of locating a printing hammer precisely at a predetermined home position at all times.

A still further object of the present invention is to provide a printing hammer assembly which is durable in structure and stable in operation.

A still further object of the present invention is to provide a printing hammer assembly which may be advantageously used in high-speed impact printers without causing any problem such as a deterioration in printing quality.

A still further object of the present invention is to provide a printing hammer assembly which is structured to be least affected by changes in use or environmental conditions.

A still further object of the present invention is to provide a printing hammer assembly which can absorb the shock energy of the returning hammer effectively to prevent the printing hammer from rebounding.

Other objects, advantages and novel features of the present invention will become apparent from the following detailed description of the invention when considered in conjunction with the accompanying drawings.

DESCRIPTION OF THE PREFERRED EMBODIMENTS

Figure 1:
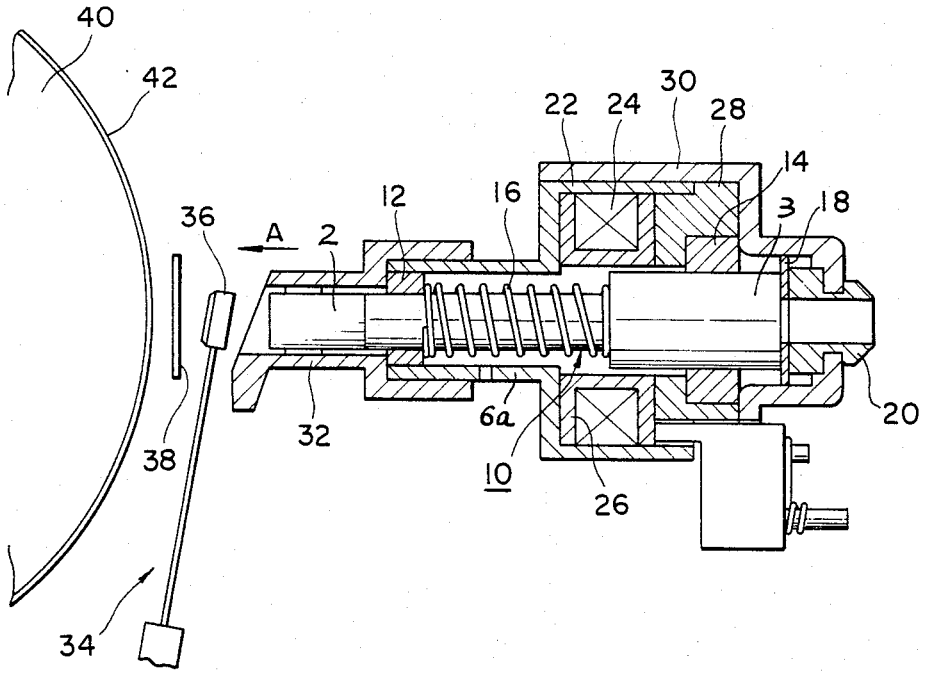
PRIOR ART Fig. 1
FIG. 1 is a cross-sectional view illustrating a prior art printing hammer assembly when applied to a wheel printer.
Figure 2:
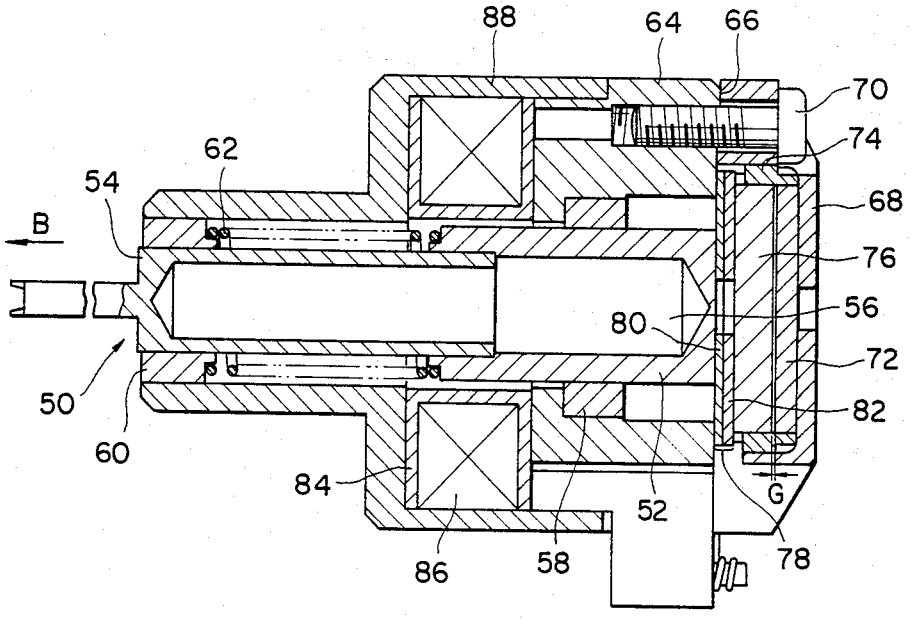
FIG. 2 is a cross-sectional view illustrating an embodiment of the present printing hammer assembly.

Referring now to FIG. 2, there is shown an embodiment of the present printing hammer assembly which includes a printing hammer 50 comprised of an armature 52 and a hammer shaft 54. The armature 52 is generally cylindrical and it has a center bore 56 opened at its front end. The hammer shaft 54 has its base end tightly fitted into the mouth of the center bore 56 to be concentrically integrated with the armature 52 and its front end machined to present a projection which is rectangular in cross section. The armature 52 is slidably supported by a rear bearing 58 and the hammer shaft 54 is slidably supported by a front bearing 60 so that the printing hammer 50 may move back and forth along its longitudinal axis. Also provided as loosely fitted onto the hammer shaft 54 and extended between the front shoulder of the armature 52 and the front bearing 60 is a compression coil spring 62 which normally biases the printing hammer 50 backward or to the right in FIG. 2. As will become clear later, any other means such as a magnet may be used to apply such a backward bias to the printing hammer 50.

The rear bearing 58 is fixedly mounted as housed in a rear yoke 64 whose rear end surface 66 is defined as a retracted position for the rear end surface of the printing hammer 50. Thus, a cap-shaped holder 68 is tightly attached to the rear end surface 66 by means of an appropriate number of screws 70. A disc-shaped magnet 72 is fixedly attached, for example, by adhesives to the inner top surface of the cap-shaped holder 68 as shown. A guide ring 74 is also fixedly attached to the holder 68 as fitted onto the disc-shaped magnet 72. And thus the holder 68, magnet 72 and guide ring 74 form an integrated structure. Another disc-shaped magnet 76 is provided with the same polarity facing opposite to that of the fixedly attached magnet 72 as movably received inside of the guide ring 74. The movable disc-shaped magnet 76 is not fixedly attached to anywhere and it is movably received in the guide ring 74, and, thus, it can move toward or away from the stationary disc-shaped magnet 72 as guided by the guide ring 74.

Since the stationary and movable magnets 72 and 76 are so disposed to face their magnetic poles of the same polarity opposed to each other, the movable magnet 76 is normally biased to the forward direction due to the magnetic repulsion between the two magnets 72 and 76. It is to be noted that the movable magnet 76 also receives an additional bias force in the forward direction due to the magnetic attractive force applied by the rear yoke 64. A stopper plate 78 is integrally provided as fixedly attached, for example, by adhesives to the front end surface of the movable magnet 76. The stopper plate 78 in the illustrated example has a composite structure and it is comprised of an adhesion preventing plate 80, for example, of teflon or polyester and a back-up plate 82, for example, of stainless steel. These two plates 80 and 82 are fixedly attached to each other and such a combined structure is then fixedly attached to the front end surface of the movable magnet 76. As mentioned before, since the movable magnet 76 having the integrated stopper plate 78 at its front end receives a bias force in the forward direction, the movable magnet 76 is normally held in position with the front end surface of the stopper plate 78 in abutment against the rear end surface of the rear yoke 64 or in alignment with the intended retracted position. Under the condition, the remaining front end surface of the stopper plate 78 receives the rear end surface of the printing hammer 50 to keep it in home position. Accordingly, the combined bias force applied to the movable magnet 76 in the forward direction must be sufficiently stronger than the recovery force of the spring 62. It is further to be noted that there is formed a small gap G between the stationary and movable magnets 72 and 76 when the movable magnet 76 is so located with the front end surface of the integrated stopper plate 78 abutted against the rear end surface 66 of the rear yoke 64.

In front of the rear yoke 64 is disposed a spool 84 around which is provided as wound a driving solenoid 86, which, in turn, is energized or deenergized in accordance with a printing signal supplied from a print control circuit (not shown). The spool 84, together with the solenoid 86, is tightly fitted into a front yoke 88 which is generally cylindrical in shape. The front yoke 88 is also tightly fitted onto the rear yoke 64 thereby forming an integrated yoke structure. Similarly with the previous embodiments, the front yoke 88 has a front cylindrical section and the front bearing 60 is fixedly mounted at the mouth of the front cylindrical section.

In operation, when the driving solenoid 86 is energized, there is produced a magnetic flux which passes through the front yoke 88, armature 52, rear yoke 64, so that the printing hammer 50 receives a driving force directed in the forward direction and thus it moves in the direction indicated by the arrow B against the force of the spring 62. At the end of such a forward stroke of movement, the printing hammer 50 applies an impact force on a selected type located at a predetermined printing position thereby forming an imprint of the selected type on recording paper. When the solenoid 86 is deenergized, the printing hammer 50 is electromagnetically decoupled from the solenoid 86 and thus it starts to move in the backward direction which is opposite to the direction B under the recovery force of the spring 62 and the reactive force applied to the printing hammer 50 at the time of impact with the selected type. At the end of this returning stroke, the rear end surface of the printing hammer 50 strikes the stopper plate 78, and the shock energy in this instance is absorbed by the combined bias force acting on the movable magnet 76 in the forward direction as described previously. That is, the impact force at the end of the returning stroke is counteracted by the combined bias force, which is a combination of a magnetic repulsive force between the stationary and movable magnets 72 and 76 and a magnetic attractive force between the movable magnet 76 and the rear yoke 64.

Figure 3:
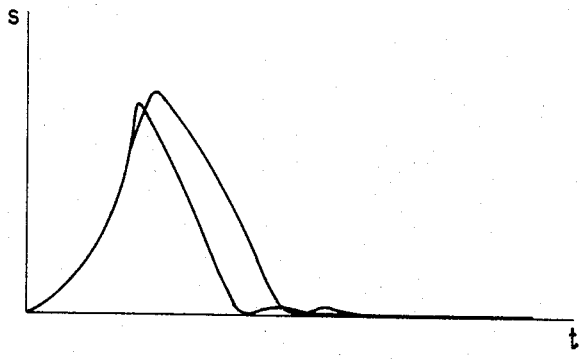
FIG. 3 is a graph useful for explaining how significantly the amount of rebound of the printing hammer of the assembly shown in FIG. 2 is decreased.

FIG. 3 is a graph showing the time-dependent movement of the printing hammer 50 in the assembly shown in FIG. 2, in which the ordinate is taken for the stroke s of movement of the printing hammer 50 and the abscissa is taken for time t. In each of the curves shown in FIG. 3, the first peak indicates the stroke of reciprocating movement of the printing hammer 50 for impacting a selected type to form an imprint and the second extremely small peak indicates rebounding motion of the hammer 50. As may be easily appreciated from the measured results shown in the graph of FIG. 3, the shock energy at the end of the returning motion is effectively absorbed and thus there is very little rebound when the rear end surface of the printing hammer 50 strikes the stopper plate 78. Actual data indicated the amount of rebound to be in the order of 0.05–0.15 mm, which is practically negligible, and it has also been found that no appreciable changes in the amount of rebound take place in the temperature range between 0° and 45°.

As a modified structure, use may be made of a tension spring instead of the compression spring 62 in order to apply a bias force to the printing hammer 50 in the backward direction. Furthermore, a stopper section, which strikes the stopper plate 78, may be provided as a recessed end surface or as a stepped portion somewhere along the outer peripheral surface of the printing hammer 50 instead of providing as the rear end surface of the printing hammer 50 as in the structure shown in FIG. 2. It should also be noted that the stopper plate 78 may be comprised of a single plate instead of a composite structure shown in FIG. 5, and, in addition, the stopper plate 78 may be totally discarded, if desired. Further, the retracted position is defined by the rear end surface 66 of the rear yoke 64 in the illustrated embodiment; however, this retracted position may be defined as a recessed end surface as shown in the previous embodiments or by any other element of the assembly.

In the embodiment illustrated in FIG. 2, provision is made of the guide ring 74 for guiding the movement of the movable magnet 76; however, such a guide ring 74 may be formed by a part of the holder 68. In this case, it is not necessary to provide the guide ring 74. It should further be noted that the stationary magnet 72 is disposed in the rear side of the movable magnet 76 with their magnetic poles of like polarity opposite to each other in the illustrated embodiment of FIG. 2; however, one or more such stationary magnets, preferably in the shape of a ring or a plurality of small magnets arranged in the form of a circle, may be provided in the front side of the movable magnet 76 such that they are in magnetically attractive relation so as to keep the movable magnet 76 aligned at the intended retracted position.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A printing hammer assembly comprising:

a printing hammer having an impact surface and a magnetically interactable means, and means for supporting said printing hammer for movement along a predetermined path in a reciprocating manner;

biasing means for normally biasing said printing hammer in a backward direction along said path;

means for producing, when energized, a magnetic flux passing through said magnetically interactable means of said printing hammer to cause said printing hammer to move in a forward direction along said path against the bias force of said biasing means; and a first permanent magnet and a second permanent magnet disposed in a magnetically repulsive relation such that said first permanent magnet is normally forced to take a predetermined resting position by said second permanent magnet against the bias force of said biasing means.

2. An assembly as in claim 1 wherein said first permanent magnet is movable and said second permanent magnet is fixed, and wherein a predetermined gap is provided between said first and second permanent magnets when said first permanent magnet is located at said predetermined resting position.

3. An assembly as in claim 2 including a plate means fixedly mounted on one surface of said first permanent magnet, said plate means being engageable with a rear end surface of said printing hammer.

4. An assembly as in claim 3 further comprising stopper means engageable with said plate means such that said predetermined resting position is defined by the position of said first permanent magnet when said plate means is in engagement with said stopper means.

5. An assembly as in claim 4 further comprising a guide ring for guiding the movement of said first permanent magnet.

6. An assembly as in claim 2 further comprising guiding means for guiding the movement of said first permanent magnet with respect to said fixed, second permanent magnet.

7. An assembly as in claim 3 wherein said plate means includes a first plate of stainless steel which is fixedly mounted on said one surface of said first permanent magnet.

8. An assembly as in claim 7 wherein said plate means further includes a second plate of adhesion preventing material, which is fixedly attached to said first plate to form therewith a dual layer structure.

9. An assembly as in claim 8 wherein said adhesion preventing material is selected from the group consisting of teflon and polyester.

10. An assembly as in claim 3 wherein said plate means is fixedly mounted on said first magnet by means of an adhesive material.

11. An assembly as in claim 1 wherein said first and second permanent magnets are disc-shaped.

12. An assembly as in claim 11 wherein said first and second disc-shaped permanent magnets have approximately the same size.

* * * * *